US007425240B2

(12) United States Patent
Guelton et al.

(10) Patent No.: US 7,425,240 B2
(45) Date of Patent: Sep. 16, 2008

(54) METHOD FOR THE PRODUCTION OF A SIDERURGICAL PRODUCT MADE OF CARBON STEEL WITH A HIGH COPPER CONTENT

(75) Inventors: Nicolas Guelton, Metz (FR); Michel Faral, Metz (FR); Jean-Pierre Birat, Semecourt (FR); Catherine Juckum, Paris (FR)

(73) Assignee: Usinor, Puteaux (FR)

( * ) Notice: Subject to any disclaimer, the term of this patent is extended or adjusted under 35 U.S.C. 154(b) by 442 days.

(21) Appl. No.: 10/501,456

(22) PCT Filed: Jan. 13, 2003

(86) PCT No.: PCT/FR03/00088

§ 371 (c)(1),
(2), (4) Date: Sep. 29, 2004

(87) PCT Pub. No.: WO03/057928

PCT Pub. Date: Jul. 17, 2003

(65) Prior Publication Data

US 2005/0028898 A1 Feb. 10, 2005

(30) Foreign Application Priority Data

Jan. 14, 2002 (FR) ..... 02 00387

(51) Int. Cl.
*C21D 8/02* (2006.01)

(52) U.S. Cl. ..... 148/547; 148/602; 148/603; 148/541; 148/651; 148/654

(58) Field of Classification Search ..... 148/601–603, 148/650–654, 661–663, 540–541, 546–547, 148/646, 328, 332, 320, 657
See application file for complete search history.

(56) References Cited

U.S. PATENT DOCUMENTS 4,925,500 A * 5/1990 Kishida et al. ..... 148/602

(Continued)

FOREIGN PATENT DOCUMENTS

EP 641 867 A1 3/1995

(Continued)

OTHER PUBLICATIONS

Patent Abstracts of Japan, vol. 2000, No. 14, Mar. 5, 2001 & JP 2000 309848, (Nippon Steel Corp.) Nov. 7, 2000.

(Continued)

*Primary Examiner*—Deborah Yee
(74) *Attorney, Agent, or Firm*—Sughrue Mion, PLLC

(57) ABSTRACT

The invention relates to a method for producing a siderurgical product made of carbon steel having a high copper content, according to which: —a liquid steel having the composition: 0.0005%≦1%; 0.5≦Cu≦10%; 0≦Mn≦2%; 0≦Si≦5% 0≦Ti≦0.5%; 0≦Nb≦0.5%; 0≦Ni≦5%; 0≦Al≦2%, the remainder being iron and impurities, is produced;—said liquid steel is poured directly in the form of a thin strip having a thickness of no more than 10 mm;—the strip is subjected to forced cooling and/or is surrounded by a non-oxidizing atmosphere while having a temperature of more than 1000? C.; —said thin strip is hot rolled at a reduction rate of at least 10%, the temperature at the end of the rolling process being such that all of the copper is still in a solid solution in the ferrite and/or austenite matrix;—and the strip is coiled. The invention also relates to a siderurgical product obtained according to said method.

19 Claims, 2 Drawing Sheets

U.S. PATENT DOCUMENTS

Figure 1A:
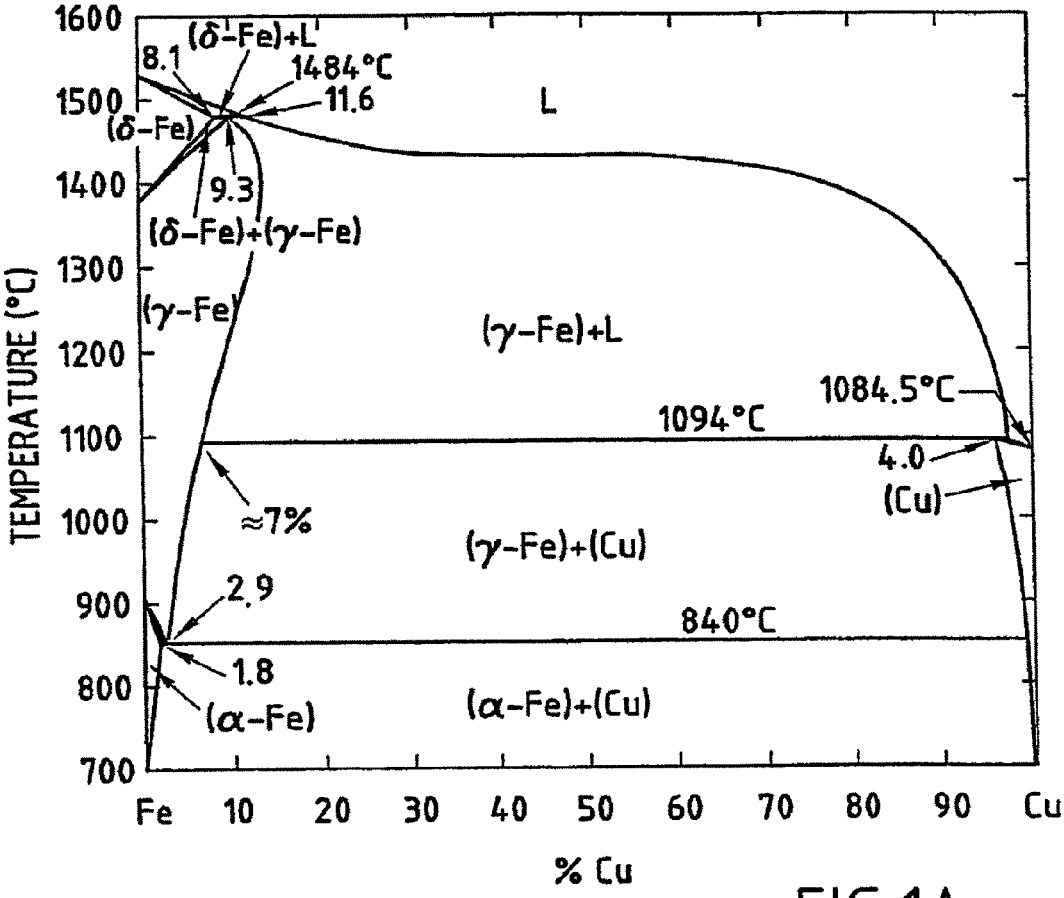

| | | | | | |
|---|---|---|---|---|---|
| 4,961,793 | A | * | 10/1990 | Kishida et al. | 148/603 |
| 5,098,489 | A | * | 3/1992 | Yamakawa et al. | 148/602 |
| 5,470,529 | A | | 11/1995 | Kunishige et al. | |
| 6,676,774 | B2 | * | 1/2004 | Matsuoka et al. | 148/328 |

FOREIGN PATENT DOCUMENTS

| | | | | |
|---|---|---|---|---|
| EP | 969 112 | A1 | 1/2000 | |
| EP | 1 072 689 | A1 | 1/2001 | |
| EP | 1 195 447 | A1 | 4/2002 | |
| EP | 1 201 780 | A1 | 5/2002 | |
| JP | 6-292949 | * | 10/1994 | 164/476 |
| JP | 07-265908 | * | 10/1995 | |
| JP | 9-209039 | * | 8/1997 | |
| WO | WO 01 77400 | A1 | 10/2001 | |
| WO | WO 01 81640 | A1 | 11/2001 | |

OTHER PUBLICATIONS

Patent Abstracts of Japan, vol. 1997, No. 05, May. 30, 1997 & JP 09 020959, (NKK Corp.) Jan. 21, 1997.

Patent Abstracts of Japan, vol. 1997, No. 12, Dec. 25, 1997 & JP 09 209039, (Nisshin Steel Co. Ltd.) Aug. 12, 1997.

* cited by examiner

METHOD FOR THE PRODUCTION OF A SIDERURGICAL PRODUCT MADE OF CARBON STEEL WITH A HIGH COPPER CONTENT

The invention relates to the field of production of ferrous alloys, and more specifically to the field of production of steels having a high copper content.

Copper is generally considered to be an undesirable element in carbon steels because, by promoting fissuring in heat, it complicates hot-working of the steel, on the one hand, and adversely affects the quality and surface appearance of the products, on the other hand. For these reasons, the copper content of high-quality carbon steels is conventionally limited to contents of less than 0.05%. As the copper present in the liquid steel cannot be removed, these low copper contents can only be achieved reliably by producing the steel from liquid cast iron, and this is only economically viable in mass production or when producing the steel in an electric arc furnace by melting carefully selected and therefore expensive iron and steel scrap.

However, there are cases where the presence of a high copper content in the steel may be desirable. The copper may have beneficial effects in specific applications, in particular in the automotive industry.

Firstly, it increases the resistance of the steel to deformation by a precipitation which may be obtained by tempering (structural hardening).

On the other hand, it improves the resistance of the steel to atmospheric corrosion as it leads to the formation of a protective oxide layer.

Finally, it increases the resistance to embrittlement by hydrogen in two ways:

- by the formation of said protective oxide layer;
- by taking the place of the manganese, it limits the formation of MnS inclusions round which the hydrogen accumulates.

The increase in the strength of the steel owing to the structural hardening may be evaluated at approx. 300 MPa per 1% of copper. However, it is difficult to benefit from this phenomenon because, in conventional systems for the production of sheets by continuous casting of thick or thin slabs, hot-rolling in a strip mill and cold-rolling, the copper adversely affects the surface quality owing to skin fissuring during hot transformation in an oxidising atmosphere. This fissuring is known as "crazing". A copper content of less than 1%, or even 0.5%, is therefore imperative unless this fissuring is limited by an addition of nickel or silicon or by reheating prior to hot transformation at a temperature lower than the peritectic melting temperature of copper (1094° C. for a pure Fe—Cu alloy), and this restricts the available range of thicknesses, or by control of the reheating atmosphere, which is incompatible with current production plants.

In addition, the precipitation hardening capacity of the copper is best when the copper is kept completely in a solid solution prior to the precipitation treatment by quenching. The higher the precipitation temperature, the less the precipitation contributes to hardening. Therefore, the copper must not precipitate during cooling, as long as the tempering temperature is not reached. The conventional production path does not allow the performance of the quenching required to maximise the hardening capacity.

It has been proposed in the document EP-A-0 641 867 to produce carbon steel strips containing large quantities of copper (0.3 to 10%) and tin (0.03 to 0.5%) by a process for the direct casting of thin strips having a thickness of 0.1 to 15 mm, such as casting between rolls. The rapid solidification of the strip and the possibility of limiting the residence time of the strip at more than 1000° C., by cooling following this solidification, enable the above-mentioned problems of surface quality to be solved. The strip is then cold-rolled. It is thus possible to produce strips having good mechanical properties and a good surface appearance without using raw materials which are depleted in copper and tin. For this purpose, it is necessary to obtain a product of which the primary dendrites are spaced by 5 to 100 μm after the solidification thereof. The mechanical properties desired of the thin strip are basically high strength and good tensile elongation. However, this document does not give details of the treatments following casting which would lead to a sheet suitable for an industrial application.

The object of the invention is to propose complete processes for producing hot-rolled or cold-rolled carbon steel sheets having excellent mechanical properties, in particular high strength, good anisotropy of the deformations and a good welding capacity, in which a high copper content is tolerated or even desired.

The invention accordingly relates to a process for manufacturing a steel product made of copper-rich carbon steel, wherein:

- a liquid steel is produced, which has the following composition, expressed as percentages by weight:

$0.0005\% \leqq C \leqq 1\%$
$0.5 \leqq Cu \leqq 10\%$
$0 \leqq Mn \leqq 2\%$
$0 \leqq Si \leqq 5\%$
$0 \leqq Ti \leqq 0.5\%$
$0 \leqq Nb \leqq 0.5\%$
$0 \leqq Ni \leqq 5\%$
$0 \leqq Al \leqq 2\%$ the remainder being iron and impurities resulting from production;

- this liquid steel is cast directly into the form of a thin strip having a thickness less than or equal to 10 mm;
- the strip is cooled rapidly to a temperature less than or equal to 1000° C.;
- the thin strip is subjected to hot-rolling at a reduction rate of at least 10%, the end-of-rolling temperature being such that, at this temperature, all the copper is still in a solid solution in the ferrite and/or austenite matrix;
- the strip is subjected to forced cooling so as to keep the copper in a supersaturated solid solution in the ferrite and/or austenite matrix;
- and the strip is coiled.

Preferably, the Mn/Si ratio is greater than or equal to 3.

The thin strip may be cast on a casting installation between two internally cooled rolls rotating in opposite directions.

Hot-rolling of the strip is preferably carried out in line with casting of the strip.

The rate V of forced cooling after hot-rolling is such that $$V > e^{1.98(\%\,Cu)-0.08}$$

wherein V is expressed in ° C./s and % Cu in % by weight.

According to a variation of the process, the carbon content of the steel is between 0.1 and 1% and the strip is coiled at a temperature higher than the temperature $M_s$ at the beginning of martensitic transformation.

According to a further variation of the process, the strip is coiled at less than 300° C. and the strip is then subjected to a copper precipitation heat treatment at between 400 and 700° C. Under these conditions, if the carbon content is between 0.1 and 1%, the heat treatment is preferably not preceded by uncoiling.

According to a further variation of the process, coiling of the strip is carried out at a temperature which is both higher than the temperature $M_s$ at the beginning of martensitic transformation and lower than 300° C., and is followed by cold-rolling rolling, recrystallisation annealing in a temperature range where the copper is in a supersaturated solid solution, forced cooling to keep the copper in a solid solution, and precipitation tempering.

Said precipitation tempering is carried out in a continuous annealing installation at between 600 and 700° C. or in a batch annealing installation at between 400 and 700° C.

According to a further variation of the process, coiling of the strip is carried out at a temperature which is both higher than the temperature $M_s$ at which the martensitic transformation begins and lower than 300° C., and is followed by cold-rolling and batch annealing at between 400 and 700° C. which acts as both recrystallisation annealing and precipitation tempering.

If the strip is subjected to cold-rolling, the carbon content of the steel is preferably between 0.1 and 1%, or between 0.01 and 0.2%, or between 0.0005% and 0.05%. In the latter case, its copper content is preferably between 0.5 and 1.8%.

Also in this latter case, prior to precipitation tempering, the strip may be cut to form a sheet which is shaped by drawing, and precipitation tempering may be carried out on the drawn sheet.

Lastly, the strip may be subjected to a final treatment in a skin-pass rolling mill.

The invention also relates to a steel product obtained by one of the aforementioned processes.

It will be appreciated that the invention basically involves casting a steel of the specified composition directly into a thin strip, then subjecting it to conditions which avoid crazing (either by rapid cooling of the strip as it leaves the ingot mould, bringing it to less than 1000° C., or by keeping the strip in a non-oxidising atmosphere at least until this temperature is reached), then carrying out hot-rolling of the strip, preferably in line, followed by forced cooling, keeping the copper in a supersaturated solid solution. The strip is then coiled. It may therefore be subjected to various thermal or mechanical treatments to impart its thickness and final properties.

Figure 1B:
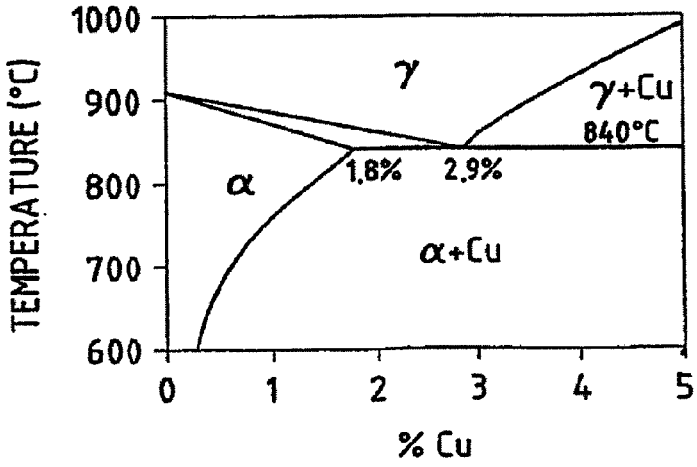
Figure 2:
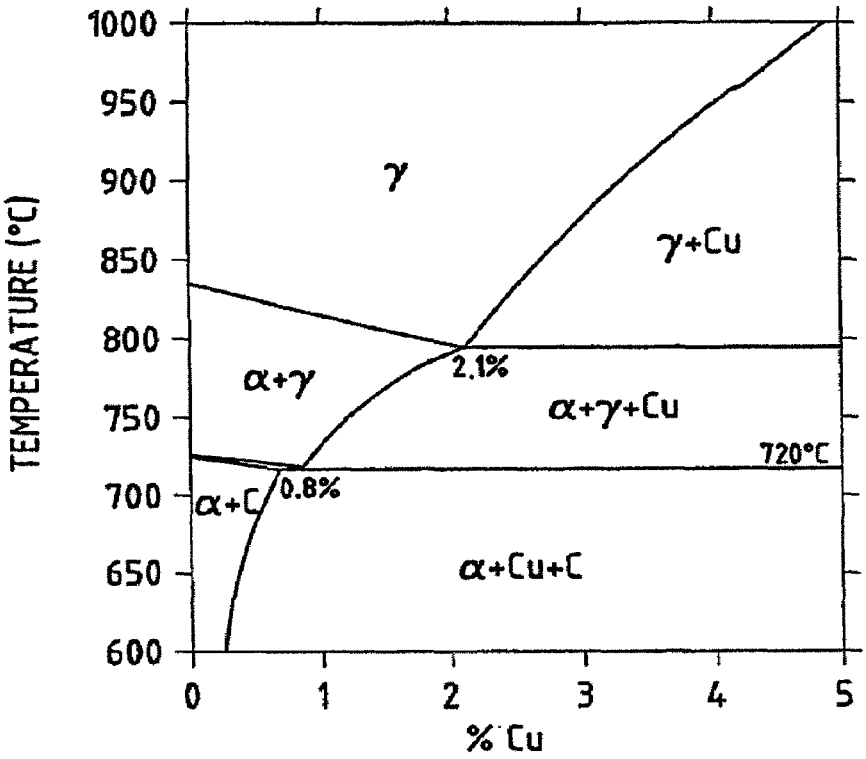

The invention will now be described in more detail with reference to the following accompanying figures, in which FIG. 1 shows the phase diagram of the pure iron/copper alloy in its entirety (FIG. 1*a*) and for copper contents less than or equal to 5% and temperatures of 600 to 1000° C. (FIG. 1*b*);

FIG. 2 shows a portion of the phase diagram of an iron/copper alloy containing 0.2% of carbon.

Firstly, a liquid metal having the following composition (all contents are expressed as percentages by weight) is produced.

The carbon content may range from 0.0005% to 1%, depending, in particular, on the envisaged applications of the final product. The lower limit of 0.0005% corresponds in practice to the minimum that it is possible to obtain by conventional processes of decarburisation of the liquid metal. The upper limit of 1% is justified by the gammagenic effect of the carbon. Beyond 1%, the carbon excessively reduces the solubility of the copper in the ferrite. Beyond 1%, moreover, the weldability of the steel is significantly impaired, and this makes it unsuitable for numerous preferred applications of sheets obtained from the steels of the invention.

In addition, the carbon leads to a hardening effect, and to the precipitation of titanium and/or niobium carbides which are used to control the texture, if titanium and/or niobium are present in significant quantities in the steel.

In general, it may be stated that:

- if the carbon content is between 0.1 and 1%, the steels obtained have a preferred. application in the field of hot-rolled very high strength sheets if, after casting, they have been coiled at a temperature which allows precipitation tempering or if they have been coiled at a low temperature and have then been tempered, or in the field of very high strength cold-rolled sheets;
- if the carbon content is between 0.01 and 0.2%, the steels obtained have a preferred application in the field of high strength weldable steels if they have been hot-rolled or if they have been cold-rolled and heat treated under conditions which will be seen hereinafter;
- if the carbon content is between 0.0005% and 0.05%, the steels obtained have a preferred application in the field of drawing, if they have been cold-rolled and preferably contain at most 1.8% of the copper (for which the reasons will be seen hereinafter).

A carbon content of approximately 0.02% is typical of the steels of the invention, apart from hot- or cold-rolled very high strength steels.

The copper content of the steel is between 0.5 and 10%, preferably between 1 and 10%.

Below 0.5%, the copper does not have a precipitation hardening effect or, more exactly, the driving force for precipitation is too weak to obtain precipitation hardening within reasonable conditions of time and temperature in the perspective of an industrial application. In practice, it is preferable to have at least 1% of copper in the steel to benefit from its hardening effect.

When producing a steel which is intended to form hot-rolled strips, there is no metallurgical limit to the copper content, providing the conditions of cooling rate and end-of-cooling temperature of the thin strip after the casting thereof are respected. Cooling must begin in the 100% austenitic range (the γ-Fe range in FIG. 1*a*) and must be sufficiently fast to keep all of the copper in a solid solution. The limit is therefore technological. For example, the copper content (2.9%) where the temperature of appearance of the ferrite is lowest (approx. 840° C., see FIG. 1) and at which the critical cooling rate beyond which the copper remains in a solid solution is still easily accessible (it is approx. 350° C./s for this content) may be targeted. An increase in the copper content necessitates an increase in the cooling rate and the end-of-rolling temperature. The end-of-rolling temperature is dependent on the limit of solubility of the copper in the austenite. However, contents of approx. 4% of copper, necessitating hot-rolling above 1000° C. and then cooling the strip at more than 2,500° C./s are still accessible by thin strip casting technology, providing that the hot product has a low speed of travel of approx. a few m/s.

When producing a steel intended for forming cold-rolled strips, it is necessary to subject the cold-rolled sheet to a recrystallisation treatment. Two variations may be selected for this purpose.

According to the first variation, the recrystallisation treatment is disassociated from the precipitation treatment (as in the case of high strength cold-rolled sheets for drawing). At the recrystallisation temperature, the copper must be completely in a solid solution in the monophase ferritic range. The maximum copper content is therefore determined by the limit of solubility of the copper in the ferrite at the recrystallisation temperature under consideration. It is a maximum of 1.8% at the maximum permissible recrystallisation temperature of 840° C. (see FIG. 1*b*).

According to the second variation, the recrystallisation treatment and the precipitation treatment are linked (as in the case of high strength cold-rolled sheets). Very high copper contents of up to 10% may be tolerated if batch annealing is carried out. However, the recrystallisation optimum may not coincide with the precipitation optimum, and the treatment parameters then have to be selected so as to produce the best compromise for the envisaged application.

Typically, copper contents of approx. 3% and 1.8% may be recommended, according to the applications.

The manganese content must be kept lower than or equal to 2%. Similarly to carbon, manganese has a hardening effect. In addition, it is gammagenic, so it reduces the solubility of the copper in the ferrite by reducing the breadth of the ferritic range. Typically, a manganese content of approx. 0.3% is recommended.

The silicon content may range up to 5%, without a minimum content being obligatory. However, its alphagenic nature makes it advantageous because it allows the ferritic range to be maintained even with the preferred copper contents of 1.8, or even 3%, of the steels of the invention. It is advisable to adjust the Mn/Si ratio to a value which is preferably higher than 3 in order to control, during the $\delta \rightarrow \gamma$ transformation, the transfer of roughness from the roll surface to the solidified skins and the uniformity of attachment of the solidified skins so as to avoid the formation of cracks on the strip which is being solidified and cooled. For this purpose, it is also advisable (as known) to carry out casting while using rough casting surfaces and a nitrogen-containing inerting gas which is soluble in the liquid steel so as to obtain the possibility of favourably adjusting the transfer of heat between the steel and the cast surfaces. The maximum Si content of 5% is imposed by the ease of production and casting of the grade at the steelworks. A content of approx. 0.05% is typically recommended.

The niobium and the titanium may preferably, but not imperatively, be present in contents ranging up to 0.5% each. They produce carbides which are favourable to texture control and, if they are present in an over-stoichiometric amount relative to the carbon, they raise the temperature $Ac_1$, of the steel and therefore the solubility of the copper in the ferrite. Typically, each of these elements may be present in a content of approx. 0.05%.

The nickel content may range up to 5%, this element merely being optional. The nickel is frequently added to copper steels to prevent fissuring in heat. It has a dual role. On the one hand, by increasing the solubility of the copper in the austenite, the nickel delays the segregation of the copper at the metal/oxide interface. On the other hand, as it may be mixed with the copper in any proportion, the nickel increases the melting point of the segregating phase. It is normally considered that an addition of nickel which is substantially the same as that of copper is sufficient to prevent fissuring in heat. Rapid cooling and/or purging with inert gas after cooling by the process according to the invention prevent fissuring in heat and this reduces the value of an addition of nickel with this objective in mind. However, the addition of nickel may be provided to facilitate hot-rolling.

The aluminium content may range up to 2% without adversely affecting the properties of the steel, but this element is not obligatory. However, it is advantageous for its alphagenic role, comparable to that of silicon. Typically, the aluminium is present in a content of approx. 0.05%.

The other chemical elements are present as residual elements in contents resulting from production of the steel by conventional processes. In particular, the tin content is less than 0.03%, the nitrogen content less than 0.02%, the sulphur content less than 0.05%, the phosphorus content less than 0.05%.

The liquid steel, of which the composition has just been described, is then cast continuously and directly into the form of a thin strip having a thickness less than or equal to 10 mm. For this purpose, the steel is typically cast into a bottomless ingot mould, the casting space of which is limited by the internally cooled lateral walls of two rolls rotating in opposite directions and by two lateral walls made of refractory material placed against the plane ends of the rolls. This process is well known in the literature nowadays (it is described, in particular, in EP-A-0 641 867), and will not be described in detail. It is also conceivable to employ a casting process involving solidification of the steel on a single roll, and this would yield finer strips than casting between two rolls.

To avoid the problems of crazing of the strip surface associated with the intergranular infiltration of liquid copper into the steel below the scale when the temperature of the strip exceeds the melting temperature of the copper-rich phase, namely approx. 1000° C., it is then necessary:

- either to rapidly cool the ascast strip, for example by spraying with water or a water/air mixture so as to bring it below 1000° C. before copper enrichment occurs at the metal/scale interface; it is considered that this objective is achieved at a cooling rate of 25° C./s when the strip has a copper content of 3%;
- or to prevent oxidation of the iron by keeping the strip in a non-oxidising atmosphere, at least until it reaches a temperature below 1000° C.; this may be conventionally achieved by passing the strip into a chamber of which the atmosphere is lean in oxygen (less than 5%) and consists substantially of an inert gas, argon or nitrogen; the presence of a reducing gas such as hydrogen may also be considered.

These two solutions may be combined by being used simultaneously or in succession.

The strip is then subjected to hot-rolling. This may be carried out on an installation which is separate from the casting installation, after reheating the strip to a temperature not exceeding 1000° C. to avoid crazing (unless this reheating is carried out in a non-oxidising atmosphere). For economic reasons, however, it is preferable to carry out this hot-rolling in line, in other words on the same installation as casting of the strip, by placing one or more rolling stands on the strip path. In-line rolling also obviates the need for a sequence of coiling/uncoiling/reheating operations between casting and hot-rolling, which may give rise to metallurgical risks: surface fissuring, and encrustation of scale during coiling, in particular.

This hot-rolling is carried out with a reduction rate of at least 10% in one or more passes. It basically has three roles.

Firstly, the recrystallisation which it causes eliminates the solidification structure which is unfavourable to shaping of the sheet. In addition, this recrystallisation leads to refinement of the grain which is necessary for simultaneously improving the strip's properties of strength and tenacity, if it is intended for use in the state of a hot-rolled sheet.

Secondly, it closes the pores which were able to form within the strip during solidification and which would also be detrimental during shaping.

Furthermore, it guarantees that the dimensional specifications of the strip with regard to its planeness, its curvature and its symmetry are respected.

Finally, it improves the surface appearance of the strip.

The end-of-rolling temperature must be such that the copper is still in a solid solution in the ferrite and/or austenite at this stage. Precipitation of the copper before the end of rolling would not allow the maximum hardening to be obtained from it. This maximum is approx. 300 MPa for 1% of copper, when the precipitation conditions are well controlled. This end-of-rolling temperature to be respected therefore depends on the composition of the steel, in particular its copper and carbon contents.

It is thus considered that, for high copper contents of approx. 7% and higher, the end-of-rolling temperature must be higher than 1094° C., this temperature being approximately the temperature of the peritectic step of the Fe—Cu phase diagram shown in FIG. 1*a*, for very low carbon contents. This also means that hot-rolling be carried out in a non-oxidising atmosphere and that, if the strip is cooled immediately after solidification thereof, this cooling be interrupted at a sufficiently high temperature to allow subsequent hot-rolling of the strip in conditions which lead to an end-of-rolling temperature higher than 1094° C.

Between 2.9 and 7% of copper, the end-of-rolling temperature must be higher than the limit of solubility of the copper in the austenite, as shown by the Fe—Cu phase diagram, for the carbon content under consideration. By way of example, for a very low carbon content, this temperature T would be given by $$T(K) = \frac{3093}{3.186 - \log_{10}\mathrm{Cu}(\%)}$$

Between 2.9 and 1.8% of copper, the end-of-rolling temperature must be higher than 840° C. for very low carbon contents, this temperature corresponding to the eutectoid step (see FIG. 1*b*).

Below 1.8% copper, the end-of-rolling temperature must be higher than the limit of solubility of the copper in the ferrite, as shown by the Fe—Cu phase diagram, for the carbon content under consideration. By way of example, for a very low carbon content, this temperature T would be given by $$T(K) = \frac{3351}{3.279 - \log_{10}\mathrm{Cu}(\%)}$$

for paramagnetic α iron (between 840° C. and the Curie temperature of 759° C., for a copper content of 1.08 to 1.8%) and by $$T(K) = \frac{4627}{4.495 - \log_{10}\mathrm{Cu}(\%)}$$

for ferromagnetic α iron (between 690° C. and 759° C., for a copper content of 0.5 to 1.08%).

However, it should be noted that the foregoing numerical values are given merely as examples, as they vary slightly depending on the bibliographic sources.

When the carbon content of the steel increases, the foregoing figures are also changed, because the carbon has a gammagenic effect, as shown by the extract of the Fe—Cu phase diagram in FIG. 2, established for a carbon content of 0.2%. The temperature of the eutectoid step is lower than in the case of very low carbon contents and is frequently below 800° C. It is therefore possible to reduce the end-of-rolling temperature relative to the previously described cases. For these steels, which are relatively rich in carbon, moreover, structural hardening is obtained by the action of the quenching constituents which precipitate, such as bainite or martensite, and is added to the hardening associated with precipitation of the copper.

It can be seen from the foregoing that the value of the minimum end-of-rolling temperature of the process according to the invention cannot be defined quantitatively in a simple and very precise manner. What is certain, is that this end-of-rolling temperature must not be lower than the temperature at which precipitation of the copper would be observed, bearing in mind the composition of the steel. This temperature may be determined by metallurgists by routine experiments for a given steel composition, if a measure of this temperature is not available in the literature.

If hot-rolling is not performed in line, it is not necessary to keep the copper in a solid solution until coiling after casting by rapid cooling as indicated hereinbefore, because the reheating preceding hot-rolling will lead to redissolution of the copper.

After hot-rolling, the strip is subjected to forced cooling again. This cooling has a plurality of roles:

- if the end-of-rolling temperature is higher than 1000° C. (which, as we have seen, is desirable mainly for steels having a very high copper content), this cooling guarantees that significant oxidation of the iron will not occur between the end-of-rolling temperature and 1000° C. and crazing will not be observed on the strip;
- and, in particular, it allows the copper to be kept in a supersaturated solid solution in the austenite and/or ferrite; this condition is important for obtaining the maximum benefit from the effect of precipitation hardening of the copper.

For copper contents of 3% and less, it is noted that the copper is generally kept in a solid solution if the cooling rate V of the belt is such that $$V \geqq e^{1.98(\%\,Cu)-0.08} \quad (1)$$

wherein V is expressed in ° C./s and % Cu in % by weight, throughout the period of travel of the strip.

For a copper content of 1%, V must therefore be higher than or equal to 7° C./s, and this is easily attainable. For a copper content of 3%, V must be higher than or equal to 350° C./s. However, this high rate is attainable on a thin strip casting installation.

The foregoing formula is not valid for copper contents higher than 3%, and experimental monitoring of the results of cooling has to be carried to check whether the cooling has been sufficient to keep the copper in a supersaturated solid solution.

The strip is then coiled. The period when the strip remains in a coil may be used to carry out precipitation tempering of the copper, which causes hardening of the steel. The hardness of the HV steel obtained depends on the composition of the steel, but also on the period of time for which the strip remains in the form of a coil and on the coiling temperature, bearing in mind that, in practice, a coil remains at its coiling temperature for approx. 1 hour before cooling at a rate of approx. 10 to 20° C./h. It is noted that the curve HV=f(t) has a maximum $HV_{max}$ for a given period $t_{HVmax}$, beyond which the hardness decreases. It may therefore be advisable to cool the coiled strip (or to uncoil it) as soon as $t_{HVmax}$ has been reached.

Experience has shown that $t_{HVmax}$ is given by the equation:

$$t_{HV\max} = \frac{8.10^{-8}}{(\%\ \mathrm{Cu})^3} e^{\frac{14343}{T}} \quad (2)$$

with $t_{HVmax}$ in h, % Cu in % by weight and T in K.

For a given copper content, therefore, the preferred combinations ($t_{HV}$, T) which are compatible with the industrial tool used, may be selected. If it is decided to carry out tempering prior to coiling, $t_{HV}$ is imposed (longer than 1 h); it is only possible to change the coiling temperature.

On the other hand, the value of the maximum hardness which can be obtained increases when the precipitation tempering temperature decreases, provided that the strip is left for long enough to attain this maximum hardness.

In addition, the selection of the strip coiling temperature and the selection of the subsequent operations depend on the type of product to be manufactured.

As mentioned, it is possible to produce hot-rolled sheets by the process of the invention. Two modes of operation are conceivable.

According to a first mode of operation, the strip is coiled after hot-rolling at an elevated temperature, for example the temperature (calculated as a function of the copper content according to the foregoing formula (2)) that leads to the maximum hardness in 1 h (duration from which, as mentioned, the temperature of the coil normally begins to decrease). The period for which the strip is subjected to a residence at high temperature is therefore the initial phase of its residence in the form of a coil following rapid cooling.

In the case of steels having a carbon content between 0.1 and 1%, the coiling temperature additionally has to be higher than the temperature $M_s$ at which the martensitic transformation begins. The formation of martensite could cause the appearance of cracks during uncoiling. $M_s$ is obtained by the conventional formula known as the "Andrews formula":

$$M_s(^\circ\ \mathrm{C.}) = 539 - 423\ \mathrm{C}\ \% - 30.4\ \mathrm{Mn}\ \% - 17.7\ \mathrm{Ni}\ \% - 12.1\ \mathrm{Cr}\ \% - 11\ \mathrm{Si}\ \% - 7\ \mathrm{Mo}\ \%$$

wherein the contents of the various elements are expressed in % by weight.

For steels of which the carbon content is between 0.0005 and 0.1%, it is not necessary to take $M_s$ into consideration. In their case, $M_s$ is approx. 400 to 500° C., which is elevated and usually above the coiling temperature which could easily be achieved on the installation. However, there is no reason why coiling cannot be carried out below $M_s$ because:

- either bainite would have been formed during cooling (steels having a low carbon content are not "hardenable"), and this would prevent martensite formation;
- or martensite is effectively formed; as the carbon content is low, however, the amount of martensite formed is reduced and does not lead to incidents during uncoiling.

After complete cooling of the coil (which may be carried out completely naturally or may be forced after the time required for obtaining the desired hardness has elapsed, as necessary) the hot-rolled sheet is ready for use.

It should be borne in mind, however, that the germination rate of the copper precipitates is an increasing exponential function of the degree of cooling of the strip. Under these conditions, it is advisable, for obtaining the maximum precipitation hardening effect, to complete the germination phase at a temperature lower than that at which grain growth will occur. A second mode of operation may therefore be proposed for the production of hot-rolled strips. According to this second mode of operation, the strip is coiled at a temperature which is sufficiently low for precipitation of the copper not to occur during natural cooling of the coil, the copper remaining in a supersaturated solid solution. It is estimated that a coiling temperature lower than 300° C. is sufficient for this purpose. There is no reason here not to coil the strip in the martensitic transformation range. The strip (still coiled, at least if coiling took place below $M_s$) is then subjected to a tempering thermal treatment between 400 and 700° C. to cause the martensite to disappear. However, the main role of this hardening is to precipitate the copper so as to obtain the desired properties in the hot-rolled sheet. The parameters of this treatment (temperature and duration) may be determined using the foregoing equation (2).

If it is desired to produce cold-rolled sheets by the process of the invention, the coiling temperature must be higher than $M_s$ in the case of steels of which the carbon content is between 0.1 and 1%, because there is no thermal treatment for removing the martensite between the coiling and the uncoiling preceding cold-rolling. However, the coiling temperature must also always be lower than 300° C. so that cold-rolling and the subsequent recrystallisation annealing take place on a steel in which the copper is in a supersaturated solid solution.

If it is desired to manufacture cold-rolled sheets which have very high strength and may have high copper and carbon contents (0.1 to 1% of C) or cold-rolled sheets which have high strength and may easily be welded, for which a relatively low carbon content is demanded (0.01 to 0.2%), different variations of the mode of operation may be proposed, depending on whether it is desired to use a continuous annealing installation or a batch annealing installation to carry out the precipitation tempering heat treatment.

In all cases, cold-rolling (typically at a reduction rate of 40 to 80% and at ambient temperature) of the strip of which the copper is in a supersaturated solid solution is carried out first of all and is followed by recrystallisation annealing carried out in the range of high temperatures at which the copper is also in a solid solution in the ferrite and/or the austenite. The conditions suitable for this purpose have already been seen with regard to the selection of the end-of-hot-rolling temperature, depending on the copper content of the strip.

The duration of this recrystallisation annealing depends on the capacity of having previously kept the copper in a solid solution. At the recrystallisation temperature of 840° C., at which up to 1.8% of copper may be returned to a solid solution, grain growth may be excessive. If the copper is already in a solid solution prior to recrystallisation, the annealing time is determined by the kinetics of grain growth and not by the kinetics of copper precipitate dissolution. Dissolution of the copper prior to recrystallisation therefore facilitates optimisation of the texture, and this situation is the most advantageous for the metallurgist. Depending on the state in which the copper is (completely in solution or partially precipitated), recrystallisation annealing (if carried out at 840° C.) has a duration which may vary from 20 s to 5 min. It may advantageously be carried out in a "compact annealing" installation, which soon gives access to elevated temperatures which allow redissolution of large amounts of copper.

Recrystallisation annealing is followed by precipitation tempering. These two operations are separated by a stage of rapid cooling, intended to keep the copper in a solid solution. This cooling must therefore satisfy the aforementioned equation (1).

If precipitation tempering is carried out in a continuous annealing installation (preferably linked directly to the compact annealing installation used for recrystallisation annealing), in which there is little time to achieve the maximum hardness $HV_{max}$ of the strip (see equation (2) for the calculation thereof), this tempering has to be carried out at a relatively high temperature (600 to 700° C.). This limits the extent of precipitation hardening achieved because, as stated, the lower the tempering temperature, the greater this hardening.

This is why, when very high strength levels are desired, it is preferable to carry out precipitation tempering at a relatively low temperature (400 to 700° C.), but for a prolonged period, preferably determined by the foregoing equation (2), in a batch annealing installation in which the strip remains in the coiled state. In this case, the rapid cooling following the treatment has to bring the strip to less than 300° C. to keep the copper in a supersaturated solid solution.

The use of a sequence, "compact annealing followed by very rapid cooling (easily attainable on this type of installation)—batch annealing" is therefore particularly advantageous for obtaining steels having a high copper content and therefore having a high capacity for precipitation hardening and consequently very high final strength. However, this sequence is relatively long owing to the presence of batch annealing.

In a variation, as stated, it is possible to link the recrystallisation operation and precipitation operation during batch annealing carried out at 400 to 700° C. for a period which can be determined by the foregoing equation (2), without prior recrystallisation annealing, therefore directly after cold-rolling. This procedure is more particularly suitable for steels having the highest copper content (up to 10%). In some cases, the treatment parameters will have to be selected so as to obtain the best possible compromise between the requirements for recrystallisation and the requirements for precipitation of the copper.

If a cold-rolled sheet of steel with low carbon (less than 0.05%) and good drawability is to be manufactured, a mode of operation comprising, as hereinbefore, cold-rolling (typically at a reduction rate of 40 to 80% and ambient temperature) carried out on the strip in which the copper is in a supersaturated solution, recrystallisation annealing and precipitation tempering is proposed.

To enable the sheet to maintain good drawing properties, recrystallisation should be carried out in the ferritic range and must not allow the copper to precipitate. The recrystallisation temperature is therefore determined by the copper solubility limit in the ferrite, as seen hereinbefore. In practice, it may be advisable to carry out recrystallisation annealing at the eutectoid temperature (approx. 840° C. in the case of low carbon copper steels) if the solubility of the copper in the ferrite is at a maximum (1.8%).

Excessive growth of the ferritic grain during recrystallisation annealing must be avoided. It may also be necessary to raise the temperature $Ac_1$ of the steel so that complete dissolution of the copper may be carried out in the ferritic phase if cooling after hot-rolling did not allow it to be kept in a completely supersaturated form. These two requirements may be met by adding titanium or niobium. These elements also have a favourable effect on the recrystallisation texture, in particular by trapping the carbon and the nitrogen.

The hot- or cold-rolled strip may be subjected to a final treatment in a cold-working rolling mill (skin-pass), in the conventional manner, to impart its final surface state and planeness and adjust its mechanical properties.

Finally, if the use of the sheet obtained from the strips according to the invention necessitates very high drawability, it is possible to carry it out prior to precipitation tempering, which is therefore carried out on the drawn product rather than on the crude strip.

With the process according to the invention, it is possible to produce very high strength sheets which are not necessarily produced from liquid cast iron, and this makes them economical.

A further advantage of these sheets is that the presence of a large proportion of copper makes them less sensitive to atmospheric corrosion and may therefore make an anticorrosion coating unnecessary.

With regard to the mechanical properties which may be achieved by the process according to the invention:

- the hot- or cold-rolled sheets containing up to 10% of copper and from 0.1 to 1% of carbon may have strength much higher than 1000 MPa; the hot- or cold-rolled sheets having lower carbon contents have strength which is lower but is still higher than 1000 MPa, and they have good weldability which makes their use possible, in particular, in the automotive industry;
- the cold-rolled sheets containing up to 1.8% of copper and 0.05% of carbon have strength of approx. 700 to 900 MPa and elongation at break of 15 to 30%, and therefore very good drawability.

The invention claimed is:

1. A Process for manufacturing a steel product made of copper-rich carbon steel, wherein:

- a liquid steel is produced, which has the following composition, expressed as percentages by weight:

$0.1\% \leqq C \leqq 1\%$
$0.5 \leqq Cu \leqq 10\%$
$0 \leqq Mn \leqq 2\%$
$0 \leqq Si \leqq 5\%$
$0 \leqq Ti \leqq 0.5\%$
$0 \leqq Nb \leqq 0.5\%$
$0 \leqq Ni \leqq 5\%$
$0 \leqq Al \leqq 2\%$ the remainder being iron and impurities resulting from production;

- this liquid steel is cast directly into the form of a thin strip having a thickness less than or equal to 10 mm;
- the strip is cooled rapidly to a temperature less than or equal to 1000° C. by spraying with water or a water/air mixture;
- the thin strip is subjected to hot-rolling at a reduction rate of at least 10%, the end-of-rolling temperature beina such that, at this temperature, all the copper is still in a solid solution in the ferrite and/or austenite matrix;
- the strip is subjected to forced cooling so as to keep the copper in a supersaturated solid solution in the ferrite and/or austenite matrix;
- and the strip thus cooled is coiled at a temperature higher than the temperature $M_S$ at the beginning of martensitic transformation.

2. Process according to claim 1, characterised in that the Mn/Si ratio is greater than or equal to 3.

3. Process according to claim 1, characterised in that the thin strip is cast on a casting installation between two internally cooled rolls rotating in opposite directions.

4. Process according to claim 1, characterised in that hot-rolling of the strip is carried out in line with the casting of the strip.

5. Process according to claim 1, characterised in that the rate V of forced cooling after hot-rolling is such that $$V \geqq e^{1.98(\%\ Cu)-0.08}$$

wherein V is expressed in ° C./s and % Cu in % by weight.

6. A Process for manufacturing a steel product made of copper-rich carbon steel, wherein:

a liquid steel is produced, which has the following composition, expressed as percentages by weight:

0.1%≦C≦1%

0.5≦Cu≦10%

0≦Mn≦2%

0≦Si≦5%

0≦Ti≦0.5%

0≦Nb≦0.5%

0≦Ni≦5%

0≦Al≦2% the remainder being iron and impurities resultinci from production;

this liquid steel is cast directly into the form of a thin strip having a thickness less than or equal to 10 mm;

the strip is cooled rapidly to a temperature less than or equal to 1000° C. by spraying with water or a water/air mixture;

the thin strip is subjected to hot-rolling at a reduction rate of at least 10%, the end-of-rolling temperature being such that, at this temperature, all the copper is still in a solid solution in the ferrite and/or austenite matrix;

the strip is subjected to forced cooling so as to keen the copper in a supersaturated solid solution in the ferrite and/or austenite matrix;

and the strip thus cooled is coiled at less than 300° C., the strip is subjected to a copper precipitation heat treatment at between 400 and 700° C., wherein the strip is subjected to precipitation heat treatment without being uncoiled beforehand.

7. A Process for manufacturing a steel product made of copper-rich carbon steel, wherein:

a liquid steel is Droduced, which has the following composition, expressed as percentacles by weight:

0.1%≦C≦1%

0.5≦Cu≦10%

0≦Mn≦2%

0≦Si≦5%

0≦Ti≦0.5%

0≦Nb≦0.5%

0≦Ni≦5%

0≦Al≦2% the remainder being iron and impurities resulting from production;

this liquid steel is cast directly into the form of a thin strip having a thickness less than or eaual to 10 mm;

the strip is cooled rapidly to a temperature less than or eaual to 1000° C. by spraying with water or a water/air mixture;

the thin strip is subjected to hot-rolling at a reduction rate of at least 10%, the end-of-rolling temperature being such that, at this temperature, all the copper is still in a solid solution in the ferrite and/or austenite matrix;

the strip is subjected to forced cooling so as to keep the copper in a supersaturated solid solution in the ferrite and/or austenite matrix;

and the strip thus cooled is coiled at less than 300° C., wherein coiling of the strip is carried out at a temperature which is both higher than the temperature $M_S$ at which the martensitic transformation begins and lower than 300° C., and is followed by cold-rolling, recrystallization annealing in a temperature range where the copper is in a supersaturated solid solution, forced cooling to keep the copper in a solid solution and precipitation tempering.

8. Process according to claim 7, characterised in that said precipitation tempering is carried out at between 600 and 700° C. in a continuous annealing installation.

9. Process according to claim 7, characterised in that said precipitation tempering is carried out at between 400 and 700° C. in a batch annealing installation.

10. Process according to claim 7, wherein its copper content is between 0.5 and 1.8%.

11. Process according to claim 10, characterised in that, prior to precipitation hardening, the strip is cut to form a sheet which is shaped by drawing, and in that precipitation tempering is carried out on the drawn sheet.

12. Process according to claim 6, characterised in that the Mn/Si ratio is greater than or equal to 3.

13. Process according to claim 6, characterised in that the thin strip is cast on a casting installation between two internally cooled rolls rotating in opposite directions.

14. Process according to claim 6, characterised in that hot-rolling of the strip is carried out in line with the casting of the strip.

15. Process according to claim 6, characterised in that the rate V of forced cooling after hot-rolling is such that $$V \geqq e^{1.98(\%\ Cu)-0.08}$$

wherein V is expressed in ° C./s and % Cu in % by weight.

16. Process according to claim 7, characterised in that the Mn/Si ratio is greater than or equal to 3.

17. Process according to claim 7, characterised in that the thin strip is cast on a casting installation between two internally cooled rolls rotating in opposite directions.

18. Process according to claim 7, characterised in that hot-rolling of the strip is carried out in line with the casting of the strip.

19. Process according to claim 7, characterised in that the rate V of forced cooling after hot-rolling is such that $$V \geqq e^{1.98(\%\ Cu)-0.08}$$

wherein V is expressed in ° C./s and % Cu in % by weight.

* * * * *